United States Patent [19]

Hattori

[11] 4,343,157

[45] Aug. 10, 1982

[54] REFRIGERATOR

[75] Inventor: Kiyoshi Hattori, Aomori, Japan

[73] Assignee: Taisei Kogyo Kabushiki Kaisha, Aomori, Japan

[21] Appl. No.: 149,324

[22] Filed: May 13, 1980

[30] Foreign Application Priority Data

May 22, 1979 [JP] Japan ..... 54-62225

[51] Int. Cl.[3] ..... F25B 13/00

[52] U.S. Cl. ..... 62/160; 62/278; 62/324.1; 62/324.4

[58] Field of Search ..... 68/81, 278, 258.6, 324.1, 68/324.4, 160

[56] References Cited

U.S. PATENT DOCUMENTS 2,066,161 12/1936 Roessler ..... 62/160 X 4,139,356 2/1979 Hattori ..... 62/278

*Primary Examiner*—Lloyd L. King

*Attorney, Agent, or Firm*—James E. Nilles

[57] ABSTRACT

A refrigerator comprising in which a trap is provided between the outlet of a liquid receptacle and the outlet of a cooler via a normally-closed valve, a flow passage for connecting the lower portion of said trap to the outlet of a condenser is provided, and a flow passage switching mechanism for shifting, when starting a defrosting operation, the inlet of said cooler from the admission port of a compressor to the discharge port thereof, and the inlet of said condenser from the discharge port of said compressor to the admission port thereof, and for switching said normally-closed valve to open state is provided. Said refrigerator further comprising a radiator connected at its inlet to the discharge port of said compressor, a water tank or a liquid tank in which said radiator is immersed, a heat receiver immersed in said water tank or liquid tank, and an ejector connected at its inlet to the discharge port of said compressor, at its outlet to the inlet of said cooler and at its suction port to the outlet of said heat receiver.

3 Claims, 3 Drawing Figures

REFRIGERATOR

BACKGROUND OF THE INVENTION

1. Field of the Invention

The present invention relates to a refrigerator, more particularly to a defrostable refrigerator.

2. Description of the Prior Art

In refrigerators in general, the surfaces of cooling pipes and fins constituting each element in a cooler are frosted due to water in the air in the refrigeration cycle, and the thickness of the layer of frost or snow is increased with the lapse of time. Since such a layer of frost causes a remarkable decrease in cooling efficiency, it must be removed.

SUMMARY OF THE INVENTION

Therefore, an object of the present invention is to provide a refrigerator which permits defrosting a cooler at an extremely high efficiency in a short period of time by passing through the cooler a large amount of a gaseous coolant of a comparatively high temperature having a large amount of potential heat.

The above and other objects as well as advantageous features of the invention will become clear from the following description of the preferred embodiments taken in conjunction with the accompanying drawings.

DESCRIPTION OF THE PREFERRED EMBODIMENTS

Figure 1:
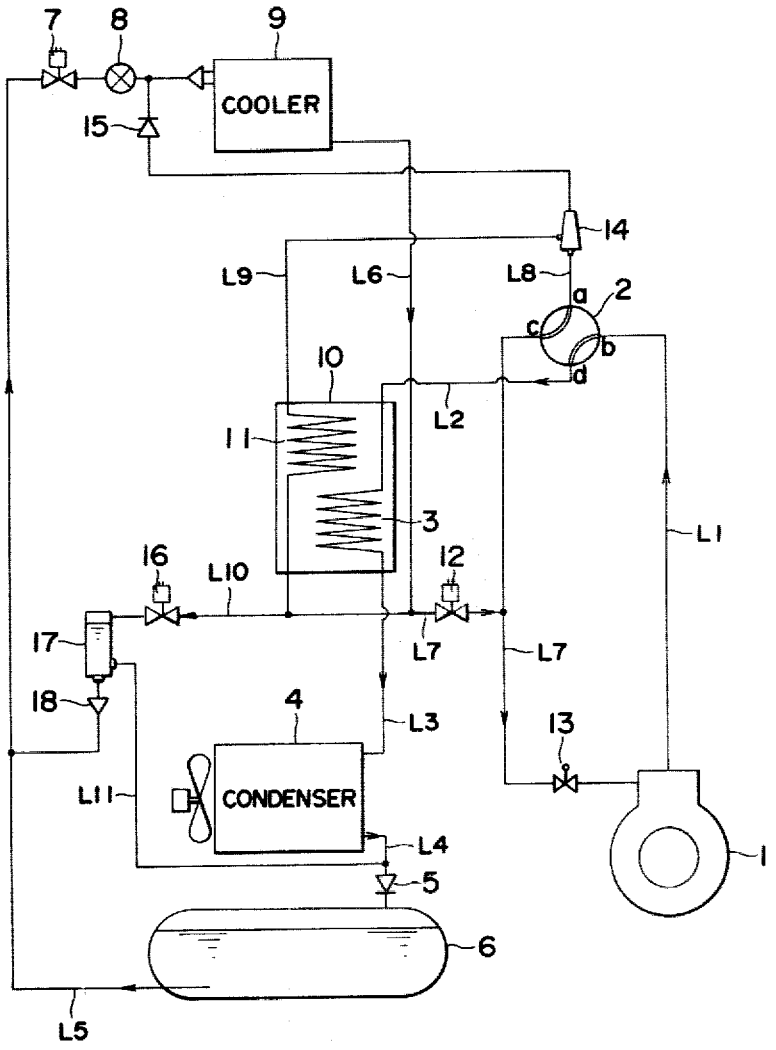
FIG. 1 is a schematic diagram showing the refrigeration cycle of a refrigerator embodying the present invention.

Referring to FIG. 1, a four-way valve 2 is connected at its port b to the front end of a flow passage $L_1$ which is extended from a discharge port of a coolant compressor 1, and a radiator 3 is connected at its inlet to a port d of the four-way valve 2 via a flow passage $L_2$. A cooling condenser 4 is connected at its inlet to the outlet of the radiator 3 via a low passage $L_3$, and a liquid receptacle 6 is connected at its inlet to the outlet of the condenser 4 via a flow passage $L_4$ and a check valve 5 which can be opened toward the liquid receptacle 6. A normally-opened valve 7 and an expansion valve 8 are connected in the mentioned order to a flow passage $L_5$ extended from the outlet of the liquid receptacle 6, and the expansion valve 8 is connected at its outlet to the inlet of the cooler 9.

A water tank 10 consisting of a heat insulating material and filled with water is provided, in which the radiator 3 and a heat receiver 11 consisting of a heat transmissible material are immersed. The radiator 3 can be formed integrally with the flow passages $L_2$, $L_3$ by winding an intermediate portion of, for example, a metal tube. Antifreezing brine can be mixed as necessary in the water in the water tank 10, and the water can be substituted by some other kind of liquid or a solid material which is soluble at normal temperature, for example, paraffin.

A flow passage $L_6$, which is extended from the outlet of the cooler 9, is connected at its front end to the inlet of the heat receiver 11. A return flow passage $L_7$ is connected at its one end to the flow passage $L_6$, and at its outlet to the admission port of the compressor 1 via a normally-opened valve 12 and a pressure-controllable suction pressure adjusting valve 13.

An ejector 14 is connected at its inlet to a port a of the four-way valve 2 via a flow passage $L_8$, and at its outlet to the inlet of the cooler 9 via a check valve 15 which can be opened in the discharge direction. The heat receiver 11 is connected at its outlet to a coolant extraction port of the ejector 14 via a flow passage $L_9$.

A flow passage $L_{10}$ is provided, which is extended from the inlet of the heat receiver 11 and which is connected to the inlet of an equalizing trap 17 for high and low pressure coolants via a normally-closed valve 16. The trap 17 is connected at its outlet to the flow passage $L_5$ via a check valve 18 which can be opened in the discharge direction. The trap 17 is communicated at its lower portion with the condenser 4 by means of the flow passage $L_{11}$ having an orifice portion.

In order to conduct a defrosting operation, the ports a, c of the four-way valve 2 are switched to the ports b, d, respectively, and the normally-closed valve 16 is opened and the normally-opened valves 7, 12 are closed.

In order to control the defrosting operation, a timer for periodically generating a defrosting starting signal, or a defrosting switch for automatically detecting the amount of snow deposited on the cooler 9 may be used to control the starting and stopping the defrosting cycle.

The check valve 18 is provided with a small aperture in its valve body so that when a liquid coolant is ready to flow from the liquid receptacle 6 to the trap 17, the greater part of the coolant is prevented from flowing in the mentioned direction but only a small amount of the coolant leaks constantly through the small aperture into the trap 17.

The above is a description of the construction of a refrigerator according to the present invention, and the following is a description of the operation of the refrigerator.

The refrigeration cycle of a refrigerator according to the present invention is normally as shown in FIG. 1.

In this refrigeration cycle, a high-temperature gaseous coolant flows from the discharge port of the compressor 1 into the radiator 3 through the flow passage $L_1$, four-way valve 2 and flow passage $L_2$. When the coolant is passed through the radiator, the radiation of heat occurs to heat the water in the water tank 10. The coolant further flows through the flow passage $L_3$ into the condenser 4, wherein the heat is removed so that the coolant is liquefied. This liquefied coolant flows through the flow passage $L_4$ into the liquid receptacle 6 so as to be stored therein. The liquefied coolant in the receptacle 6 flows through the flow passage $L_5$ and normally-opened valve 7 and expanded by means of the expansion valve 8 so that the temperature of the coolant is decreased to a low level. The resulting coolant is introduced into the cooler 9. The refrigeration according to the present invention is thus carried out.

The coolant passed through the cooler 9 flows through the flow passages $L_6$, $L_7$ and normally-opened valve 12 so as to be sucked into the compressor 1 from the admission port thereof.

Figure 2:
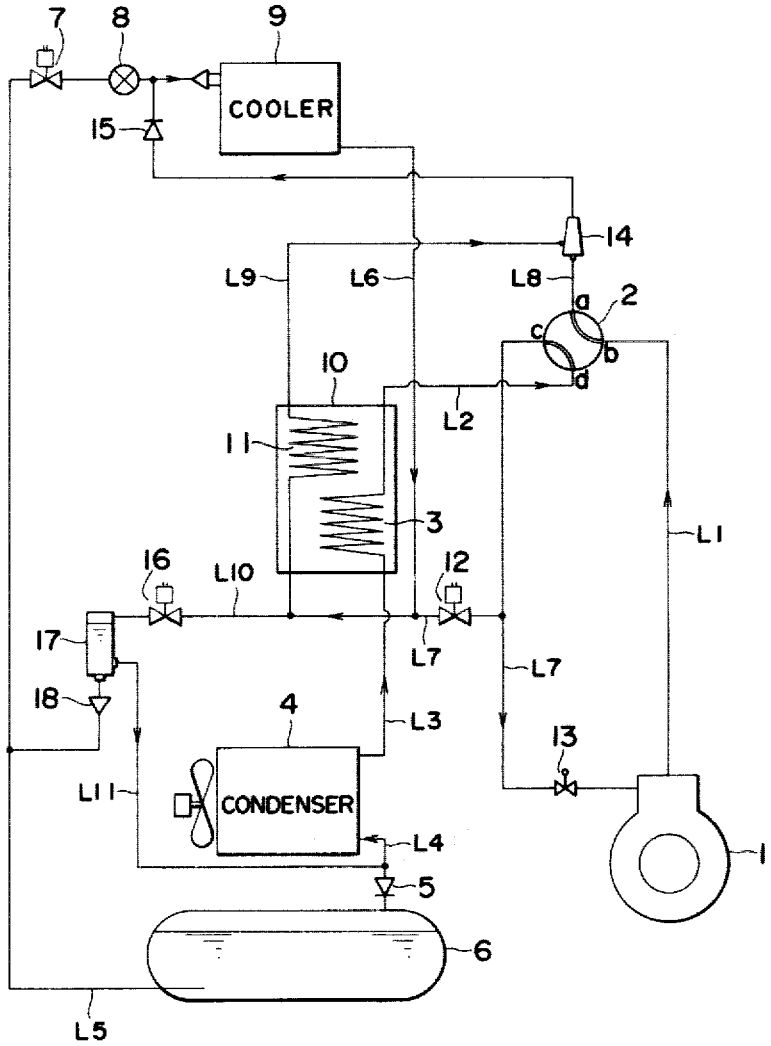
FIG. 2 is a schematic diagram showing the defrosting cycle of the embodiment shown in FIG. 1.

The defrosting cycle of a refrigerator according to the present invention is as shown in FIG. 2.

In this defrosting cycle, the four-way valve 2 is switched as shown in FIG. 2 and the normally-opened valves 7, 12 are closed and the normally-closed valve 16 is opened.

A high-temperature gaseous coolant flows from the discharge port of the compressor 1 into the inlet of the ejector 14 through the flow passage $L_1$, four-way valve 2 and flow passage $L_8$. The coolant is then ejected from the outlet of the ejector 14 into the cooler 9 with a gaseous coolant of a comparatively high temperature which is sucked into the ejector 14 from the extraction port thereof as will be described later. As a result, the cooler 9 is heated so that the snow deposited on the outer surface thereof can be melted.

At this time, the ejected gaseous coolant with which the snow has been melted is thereby cooled to be liquefied. The liquefied coolant drops from the outlet of the cooler 9 into the trap 17 through the flow passage $L_6$ and flow passage $L_{10}$ so that the coolant is stored in the trap 17. The coolant in the trap 17 flows through the orifice and the pressure is reduced as soon as the coolant has gathered in the trap 17, and the resulting coolant is jetted into the condenser 4 through the flow passage $L_{11}$. The coolant in the condenser 4 is heated with the atmospheric air of room temperature introduced thereinto by a fan provided near the condenser 4, so that the greater part of the coolant is in an evaporated state. The resulting coolant is then introduced into the radiator 3, in which the coolant is heated with the water in the water tank 10, which water has been heated by the radiator 3 in the refrigeration cycle, to be wholly turned to a gas. The gasified coolant is then returned to the compressor 1 via the pressure adjusting valve provided in the flow passage $L_7$. Thus, the above-described defrosting cycle is maintained.

During a defrosting cycle, a coolant of high temperature and pressure is jetted into the ejector 14 from the discharge port of the compressor 1 through the flow passages $L_1$, $L_8$. An extraction force is generated at the extraction port of the ejector 14 owing to the velocity energy of the jet current of the coolant. As a result, the gaseous coolant of a comparatively high temperature in the heat receiver 11 within the water tank 10 is sucked into the ejector 14 from the extraction port thereof through the flow passage $L_9$ to be put together with the coolant introduced into the ejector 14, and then jetted into the cooler 9. Thus, the defrosting cycle is maintained.

The energy applied to the compressor 1 in the refrigerator is converted into heat energy and velocity energy, and this heat energy is used to defrost the cooler. The coolant heated to be gasified in the heat receiver 11 is introduced into the cooler by the velocity energy referred to above, and this gasified coolant is also used to defrost the cooler. Accordingly, the cooler can be defrosted at an extremely high efficiency.

The coolant, if it is jetted from the compressor 1 directly into the cooler 9, retains its discharge pressure and high temperature in the cooler. This is very dangerous.

In a refrigerator according to the present invention, the coolant is jetted into the cooler at a lower pressure and a lower temperature so that the defrosting of the cooler can be carried out safely in practice.

In order to switch the refrigeration cycle to the defrosting cycle, a timer for periodically generating a defrosting starting signal is operated, or the thickness or weight of frost deposited on the outer surface of the cooler is automatically detected as mentioned above, to thereby actuate a defrosting switch (not shown), whereby a switching operation control valve can be varied. As a result, the four-way valve 2 is switched and the normally-opened valves 7, 12 are closed and the normally-closed valve 16 is opened.

As may be clearly understood from the above, a refrigerator according to the present invention, which has a very simple construction, permits the coolant to be returned to the compressor to be perfectly gasified. In the defrosting cycle of this refrigerator, a part of the heat from the heat source, i.e. the waste heat recovered by the heat receiver is jointed to the heat generated by the high-temperature coolant from the compressor so that the defrosting capacity is increased to a level higher than the level attainable by the heat from the compressor alone. Moreover, this refrigerator requires no special heating means for use in gasifying the coolant, and permits starting a defrosting operation immediately. Accordingly, a defrosting operation can be carried out properly and safely in a short period of time by using such a large amount of defrosting energy that has never been obtained in a conventional refrigerator. The compressor can be continuously operated without being interrupted throughout the refrigeration and defrosting cycles. This allows the refrigerator to be operated at a high efficiency.

Owing to the unique construction of the refrigerator, both the refrigeration cycle and defrosting cycle can be carried out easily, safely and properly. In addition, a refrigerator according to the present invention is not adversely affected by different temperatures in different places, and has a very wide application. It also permits reducing the running cost. Thus, a refrigerator according to the present invention has great material and immaterial advantages.

A refrigerator according to the present invention, which is provided with a trap 17, is advantageous in the following points.

In the refrigeration cycle, the trap 17 is always filled to the full through the flow passages $L_5$ and small aperture in the check valve 18 as mentioned above. In the defrosting cycle, a part of, or the greater part of, the high pressure liquid coolant in the trap 17 flows into the flow passage $L_{10}$ or into the outlet of the condenser 4 through the flow passage 11 immediately after a defrosting operation has been started. This serves to compensate the shortage of coolant occurring immediately after a defrosting operation has been started.

As a defrosting operation progresses, the pressure in the flow passage 10 is gradually increased. In the meantime, the liquid coolant returning from the cooler 9 is mixed with the liquid coolant jetting through the flow passage $L_5$ and small aperture in the check valve 18, to thereby automatically balance the pressure and flow rate of the liquid coolant flowing into the outlet of the condenser 4 through an orifice and flow passage $L_{11}$.

Figure 3:
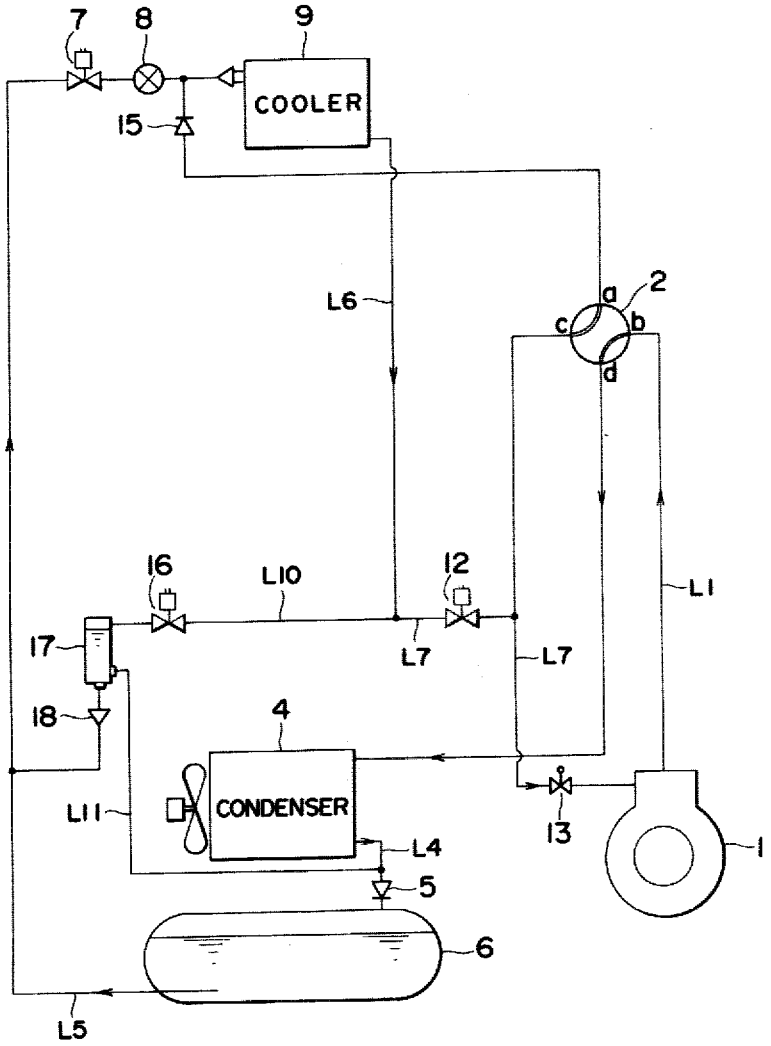
FIG. 3 is a schematic diagram showing the refrigeration cycle of another embodiment of the present invention.

When a refrigerator according to the present invention is used in a warm place where the temperature of the atmospheric air is high, the radiator 3, heat receiver 11, water tank 10 and ejector 14 may be omitted as shown in FIG. 3, to achieve the object of the invention.

The present invention is not, of course, limited to the above-described embodiments; it may be modified in various ways within the scope of the appended claims.

What is claimed is:

1. A refrigerator comprising a coolant compressor, a condenser connected at its inlet to the discharge port of said compressor, a liquid receptacle connected at its inlet to the outlet of said condenser via a check valve which can be opened toward said liquid receptacle, a cooler connected at its inlet to the outlet of said liquid receptacle via an expansion valve, flow passages for connecting the outlet of said cooler to the admission port of said compressor, a trap provided between the outlet of said liquid receptacle and the outlet of said cooler via a normally-closed valve, a flow passage for connecting the lower portion of said trap to the outlet of said condenser through a check valve having a small aperture which can be opened toward said condenser, and allows a part of coolant to flow toward said trap, a flow passage having an orifice portion for connecting the lower portion of said trap and the outlet of said trap (17), and a flow passage switching mechanism for shifting, when starting a defrosting operation, the inlet of said cooler from the admission port of said compressor to the discharge port thereof, and the inlet of said condenser from the discharge port of said compressor to the admission port thereof, and for switching said normally-closed valve to open state.

2. A refrigerator comprising a coolant compressor, a radiator connected at its inlet to the discharge port of said compressor, a condenser connected at its inlet to the outlet of said radiator, a liquid receptacle connected at its inlet to the outlet of said condenser via a check valve which can be opened toward said liquid receptacle, a cooler connected at its inlet to the outlet of said liquid receptacle via an expansion valve, a liquid tank in which said radiator is immerse, a heat receiver immersed in said liquid tank, flow passages for connecting the outlet of said cooler to the admission port of said compressor, an ejector connected at its inlet to the discharge port of said compressor, at its outlet to the inlet of said cooler and at its suction port to the outlet of said heat receiver, a trap provided between the outlet of liquid receptacle (6) and the inlet of said heat receiver via a normally-closed valve, a flow passage for connecting the lower portion of said trap to the outlet of said condenser, through a check valve having a small aperture which can be opened toward said trap (17), and allows a part of coolant to flow toward said trap, a flow passage having an orifice portion for connecting the lower portion of said trap and the outlet of said condenser, and a flow passage switching mechanism for shifting, when starting a defrosting operation, the inlet of said ejector from the admission port of said compressor to the discharge port thereof, and the inlet of said radiator from the discharge port of said compressor to the admission port thereof, and for switching said normally-closed valve to open state.

3. A refrigerator according to claim 2, wherein said flow passage connected between said trap and the outlet of said liquid receptacle is provided with a check valve having a small aperture to thereby allow the coolant to flow toward said liquid receptacle but prevent the coolant from flowing in the opposite direction to the widely extent.

* * * * *